United States Patent [19]

Stuiber et al.

[11] 4,248,542

[45] Feb. 3, 1981

[54] TAB STOP ASSEMBLY

[75] Inventors: Walter Stuiber, Karben; Otto Gluck, Schoneck; Rudolf Schicketanz, Butzbach, all of Fed. Rep. of Germany

[73] Assignee: Adlerwerke vorm. Heinrich Kleyer A.G., Frankfurt, Fed. Rep. of Germany

[21] Appl. No.: 56,251

[22] Filed: Jul. 10, 1979

[30] Foreign Application Priority Data

Jul. 11, 1978 [DE] Fed. Rep. of Germany ..... 2830384

[51] Int. Cl.[3] ..... B41J 21/04

[52] U.S. Cl. ..... 400/298; 400/295.1; 400/694

[58] Field of Search ..... 400/294, 295, 295.1, 400/295.2, 298, 434.2, 694

[56] References Cited

U.S. PATENT DOCUMENTS

| | | | |
|---|---|---|---|
| 1,002,042 | 8/1911 | Davis | 400/298 |
| 1,118,339 | 11/1914 | Frantz | 400/298 X |
| 3,283,872 | 11/1966 | Frechette | 400/298 X |
| 3,633,723 | 1/1972 | Kosters | 400/694 X |
| 3,974,905 | 8/1976 | Johnson | 400/694 X |

FOREIGN PATENT DOCUMENTS

| | | | |
|---|---|---|---|
| 2557953 | 6/1977 | Fed. Rep. of Germany | 400/694 |
| 307957 | 1/1969 | Sweden | 400/298 |

*Primary Examiner*—Ernest T. Wright, Jr.

[57] ABSTRACT

A tab stop assembly characterized by an integrally molded part comprising a slotted body or rack part joined to individual tab stops and including integrally formed spring elements to maintain the tab stops in position within the slots of the body after assembly.

3 Claims, 5 Drawing Figures

TAB STOP ASSEMBLY

This invention relates to tab stop assemblies; more particularly to a tab stop assembly having a unitary molded rack body with tab stops and spring elements integral therewith; and specifically to a tab stop assembly wherein the integrally formed tab stops can be positioned within the slots of the body in an easy assembly operation and held in position by a detent rod.

Tab stop assemblies are known, for example, German Pat. No. 1,205,989, and are quite satisfactory in their operation. The manufacture of such assemblies, however, is elaborate and expensive in that the tab stops in such assemblies are stampings which must be inserted individually in slots of a rack which is likewise produced by stamping and then bent. Further, such assemblies are provided with springs for detentably holding the tab stops which also are expensive to assemble.

With modern plastic materials and injection molding machines it is possible to design a mold to produce in a single mold a part comprising a tab rack, tab stops and spring and detent formations. The only additional part required in the tab stop assembly is a bar which serves to maintain the assembly. Due to the design of the molded part, according to the invention, the tab stops only have to be turned into the slots of the rack and held therein by means of the bar.

The complete tab stop assembly, according to the invention, may also include means to secure a mounting strip that does not require any screws.

An object of the invention is, therefore, to improve and simplify the manufacture of tab stop assemblies and thus to considerably reduce production costs.

Other objects, features and advantages of the present invention will become known to those skilled in the art from a reading of the following detailed description when taken in conjunction with the accompanying drawing wherein like reference numerals designate like or corresponding parts throughout the several views thereof, and wherein.

Figure 1:
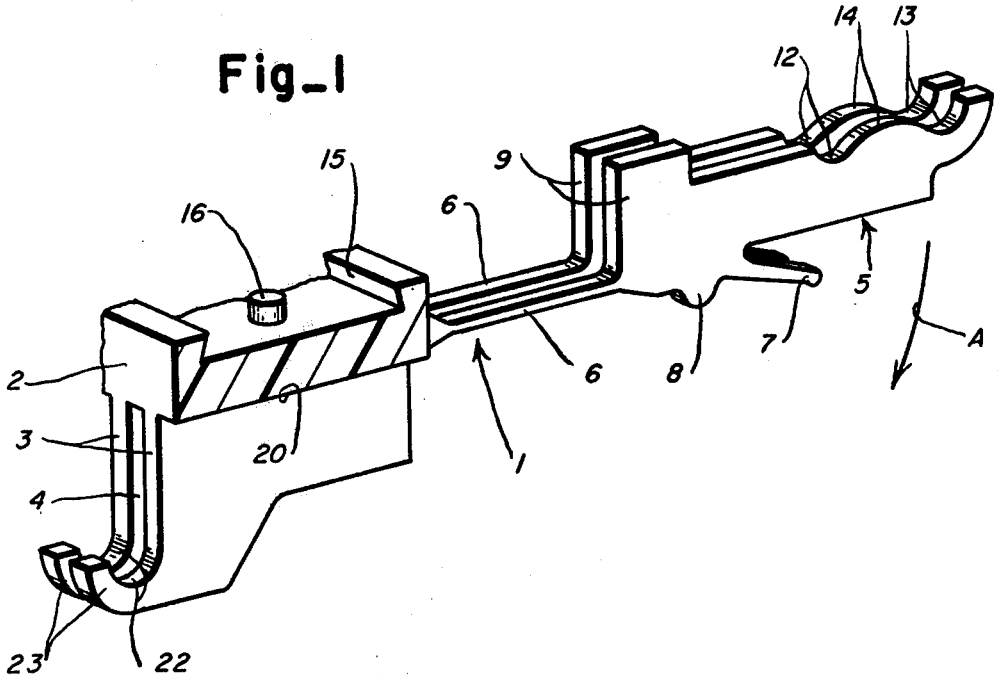
FIG. 1 is a partial perspective view showing a molded part as it comes from a mold comprising a tab rack, tab stops and detent and spring formations.

Reference is now had to the drawing wherein an embodiment of the invention is shown.

With modern injection molding machines and a suitably designed injection mold, a part comprising a slotted tab rack can be produced together with the tab stops and detent and spring formations in one operation. After formation, the part is ejected from the mold and the assembly thereof can start immediately without any additional machining.

With reference to FIG. 1, the molded part generally designated by reference numeral 1 consists of a strip-shaped body 2, formed along its length with spaced depending teeth 3 defining slots 4 which serve to support and guide tab stops 5 between unset and set positions.

The molded part 1 also consists of tab stops generally designated by reference numeral 5 which are connected to the body 2 individually by means of spring hinges 6 at intervals intermediate the teeth 3. Each of the molded tab stops 5 includes on the lower edge as viewed in FIG. 1 a spring formation 7 and a supporting nose 8, and on the opposite or upper edge, a stop lug 9 for cooperation with a tabulator lever 11 (FIGS. 3 and 4) and spaced inner and outer semi-circular recesses 12 and 13, respectively, which, together with a curved portion 14 between them, define set and unset detent formations.

Figure 3:
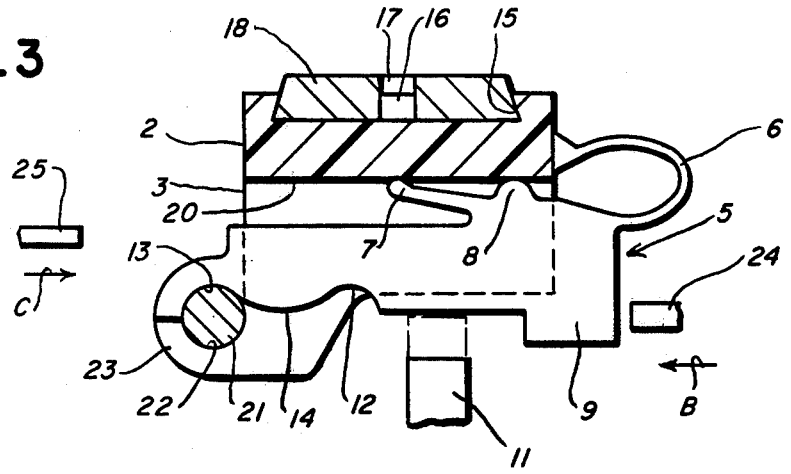
FIG. 3 is a cross-sectional view of an assembled tab stop assembly showing tab stops in their unset positions.
Figure 4:
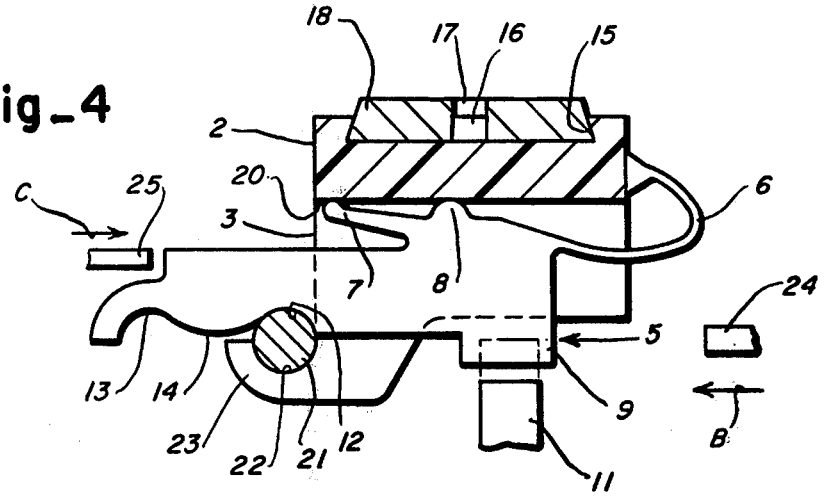
FIG. 4 is a view similar to FIG. 3 showing a tab stop in set position.
Figure 5:
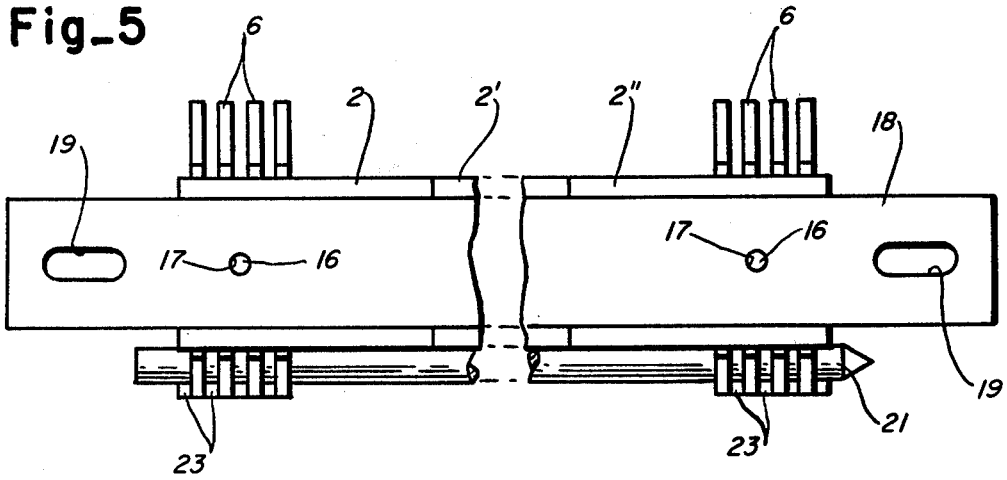
FIG. 5 is a top view of a tabular rack assembly on a reduced scale.

The side of body 2 opposite the depending teeth 3 is formed with a dovetailed groove 15 which has pins 16 at defined intervals. As shown in FIGS. 3 through 5, the pins 16 are adapted to engage bores 17 of a mounting strip 18. Due to the spring properties of the plastic of which the body 2 is formed, the complimentary-shaped mounting strip 18 may be snapped into and retained by the groove 15. Mounting strip 18 is also provided with oblong slots 19 to adjustably and accurately secure the tab stop assembly 1 on a typewriter.

Figure 2:
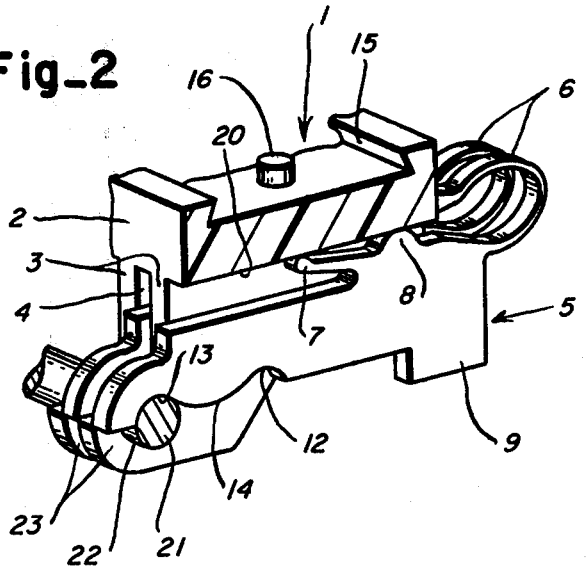
FIG. 2 is a partial perspective view showing the molded part of FIG. 1 assembled after swinging tab stops into operative assembled position.

To assemble the part shown in FIG. 1, the tab stops 5 are turned in the direction of arrow A (FIG. 1) into the slots 4 to the position shown in FIG. 2. This can be done, for example, by means of a suitable fixture so that all the tab stops 5 can be turned into associated slots 4 simultaneously. During this operation, spring formations 7 flex against the upper edges 20 of slots 4 to the extent allowed by noses 8, thereby to allow insertion of a bar 21 through an aligned circular channel defined by the semi-circular recesses 13 in the tab stops 5, and alternating complimentary-shaped semi-circular recesses 22 in curved extensions 23 on each of the teeth 3 of the body 2. As shown in FIGS. 2 and 3, the flexed spring formations 7 on the tab stops 5 and the supporting noses 8 bear against the upper edges 20 of slots 4, and the combined action of the spring hinges 6 and spring formations 7 biases the tab stops 5 against the bar 21 thereby maintaining the tab stops 5 in assembled position as shown in FIG. 3.

When a tab stop 5 is set, it is moved by means of a tab setting lever 24 in the direction of arrow B, FIG. 3. A tab stop 5 is thereby caused to move laterally or to the left as viewed in FIG. 3, causing curved portion 14 to move over bar 21 until the recess 12 defining the inner detent formation rests on bar 21. In this movement, the tab stops 5 pivot about nose 8 and spring 7 is further momentarily flexed as are the spring hinges 6 ensuring that in the set position shown in FIG. 4 a set tab stop 5 is safely, resiliently held in detent formation 12. Clearing of a tab stop 5 is effected by means of a clearing lever 25 which moves in the direction of arrow C to return a set tab stop 5 from the position shown in FIG. 4 into the unset position corresponding to FIG. 3. Again, during the clearing movement of a tab stop 5, supporting nose 8 serves as a pivot. In rest position, nose 8 has the function of determining the position of the tab stops 5 in slots 4.

If the plastic material used, after coming from a mold, is one subject to shrinkage which exceeds a certain tolerance, tab stop assembly may consist of several parts 2, 2', 2'' as shown in FIG. 5 located end-to-end and secured by a single mounting strip 18. The shrinkage of the individual parts 2, 2', 2'' or sections are thus not additive.

As it can be seen from the drawing, a tab stop assembly, according to the invention, together with the tab stops 5, can be molded from plastic in one operation and be assembled in a simple manner. Endurance tests have shown that the spring hinges 6 permit a number of movements of the tab stop 5 in both directions B and C without losing any of their spring properties. The simple clamping of the tab stop assembly to mounting strip 18 also permits simple insertion of the assembly into the typewriter as well as simple removal for servicing.

The invention claimed is:

1. A tab stop assembly for typewriters comprising a body having slots and a plurality of tab stops positioned for movement in said slots between set and unset position, said body and tab stops being formed as a unit with spring hinges connecting said body and individual tab stops, said tab stops being bendable about said hinges to enter into associated slots, said tab stops including spaced set and unset detent formations, said body having complimentary formations defining with said tab stop detent formations a channel, and a bar disposed in said channel, and said spring hinges urging said tab stop detent formations against said bar thereby to maintain said tab stops in said slots for movement between set and unset positions.

2. A tab stop assembly as recited in claim 1, further including a spring formation associated with each tab stop, and a supporting nose associated with each tab stop for resiliently urging said stop against said bar and for guiding said tab stops for movement in said slots.

3. A tab assembly as recited in claim 1, said assembly further including a dovetailed groove in said body, and a complimentary mounting strip secured in said groove.

* * * * *